United States Patent [19]

Avril

[11] Patent Number: 4,494,450

[45] Date of Patent: Jan. 22, 1985

[54] PROTECTIVE COVER FOR AN EXHAUST FAN MOTOR

[75] Inventor: Pierre Avril, Champagne sur Seine, France

[73] Assignee: Jeumont-Schneider, Puteaux, France

[21] Appl. No.: 332,104

[22] Filed: Dec. 18, 1981

[30] Foreign Application Priority Data

Dec. 31, 1980 [FR] France ..... 80 27915

[51] Int. Cl.[3] ..... F24F 7/02

[52] U.S. Cl. ..... 98/42.02; 98/1; 415/121 G; 415/219 R; 417/313

[58] Field of Search ..... 98/1, 43, 86; 415/121 G, 219 R; 417/313

[56] References Cited

U.S. PATENT DOCUMENTS

| | | | |
|---|---|---|---|
| 3,182,581 | 5/1965 | Poederoyen et al. | 98/86 X |
| 3,715,967 | 2/1973 | Field | 98/86 X |
| 3,728,956 | 4/1973 | Field | 98/86 |
| 4,044,785 | 8/1977 | Larsen | 98/1 |

FOREIGN PATENT DOCUMENTS

| | | | |
|---|---|---|---|
| 515441 | 8/1955 | Canada | 98/43 |

*Primary Examiner*—Harold Joyce

*Attorney, Agent, or Firm*—Rines and Rines, Shapiro and Shapiro

[57] ABSTRACT

A protective cover for an exhaust fan motor or the like actuable to withdraw the same by normally restrained positive pressure from the motor upon the monitoring of hot fumes representing a fire, thereby to expose the motor to a cooling environment little different from or substantially the same as that of its normal operation.

5 Claims, 3 Drawing Figures

PROTECTIVE COVER FOR AN EXHAUST FAN MOTOR

This invention relates to a method for protecting from accidental thermal constraints an exhaust fan motor or the like installed with a protective cover, at the end of an exhaust shaft on the roof of a building, for example, designed to draw off hot fumes in the event of a fire within the building (fumes at 400° C. over a period of two hours, for example), with no more than about a ten percent reduction in the exhaust flow.

Unlike the prior art, pursuant to the invention, the driving motor of the exhaust fan does not require any special design or oversize dimensions; i.e., it does not have to be designed to withstand abnormal heating, or be equipped with an auxiliary cooling apparatus (using cooled air) that is automatically activated in case of a fire; nor does it require a thermally insulated compartment, which is the case with the usual equipment of this type.

An object of the invention, indeed, is to provide a novel method of protecting exhaust fan motors and the like, as for use in drawing off hot fumes in case of fire, that does not involve such prior art design or equipment constraints.

In summary, the invention may embrace a standard construction motor used to drive the exhaust fan, with the motor mounted in the normal manner, without dampers, but provided with a protective polyester resin cover instead of a metal cover, such as is normally used on equipment of this type. The method, according to the invention, is characterized by the fact that when hot fumes occur, such protective cover is withdrawn from the motor, thereby exposing the said motor to a cooling environment little different from that of its normal operation.

The apparatus for implementing this method, according to the invention, is characterized by the fact that it includes a temperature monitor which, in case of a severe rise in temperature of the gases drawn off by the fan, activates a device for withdrawing the protective cover and a device for securing, at the end of its upward travel, the cover withdrawn from the motor-exhaust fan assembly.

The temperature monitoring can be advantageously realized in the form of a means for attaching the protective cover to the motor-exhaust fan assembly, such means of attachment being composed of a fusible material which melts under the action of hot fumes, used in combination with a device for withdrawing the protective cover by means of a spring mechanism which constantly exerts a force tending to project the cover outwards; the melting of the means of attachment thus releasing the action of this force.

Figure 1:
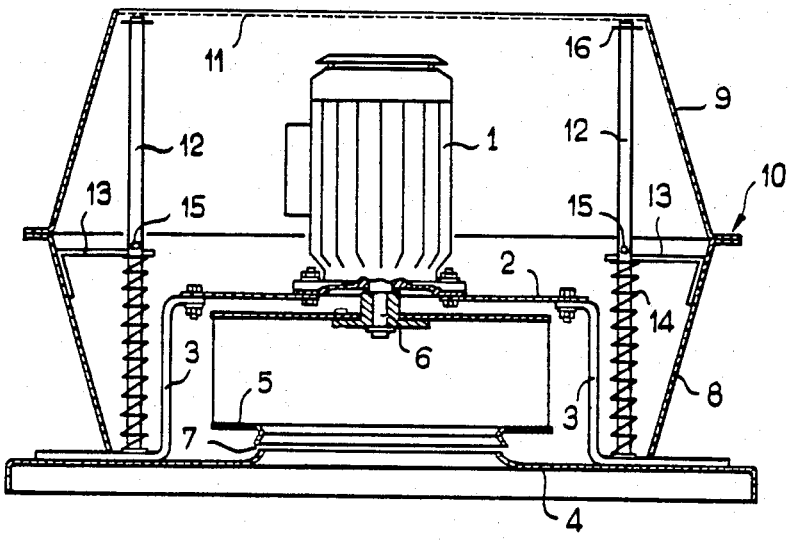
Figure 2:
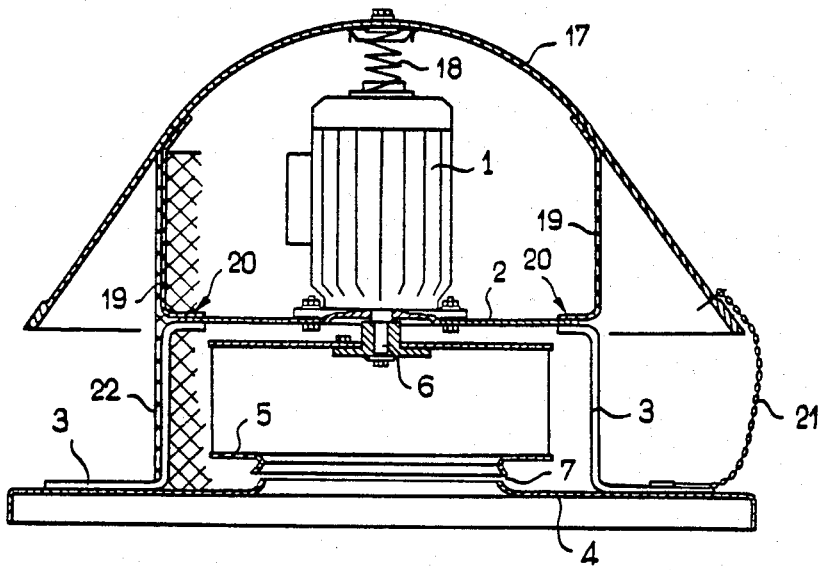
Figure 3:
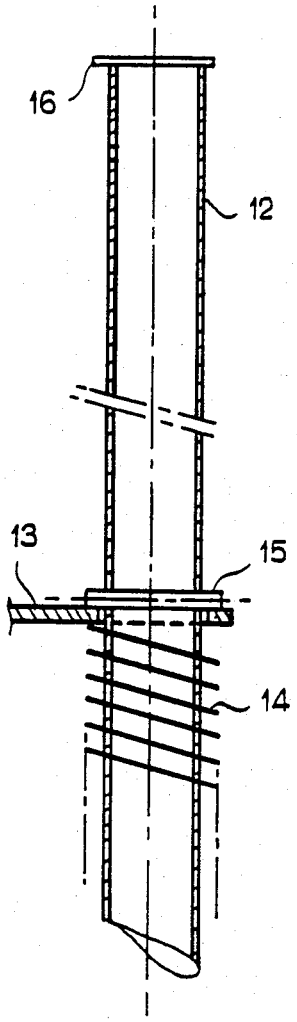

The invention may be better understood by referring to best mode working examples and the attached drawings, wherein FIG. 1 is a longitudinal section showing a motor-exhaust fan assembly with a vertical shaft, equipped with a peripheral protective cover allowing upward vertical compression of the gases;

FIG. 2 is a modification of FIG. 1, with a protective cap employed to cause lateral compression of the gases; and FIG. 3 is a cross-sectional detail of the means of attaching the protective cover of FIG. 1.

In FIG. 1, the motor (1) with a vertical shaft rests on a platform (2) attached by means of iron plates (3) to the suction flange (4) located atop the exhaust shaft (not shown in the drawing). A centrifuge turbine (5) is attached to the end of the bottom shaft (6) of the motor (1). The gap (7) between the flange (4) and the turbine (5) is calculated to take into account the potential warping of these two parts under the action of heat when the exhaust fan must draw off hot fumes resulting from a fire. A protective cover, for example in two parts (8) and (9), joined by bolts (10), encloses the motor-exhaust fan assembly, with the exception of the upper part which is open and which is equipped with a protective grill (11).

Vertical guiding rods (12), four in number, for example, are attached at their bottom ends to the iron plates (3) and are slightly shorter than the protective cover (8–9). They pass through braces (13) attached to part (8) of the cover by bolts. Below these braces (13) the rods (12) are enclosed by a cylindrical compression spring (14). Immediately above the braces (13), the rods (12) are bored with a transverse hole to allow for the passage of a pin (15) made of an ordinary fusible alloy which melts at temperatures lower than that of the hot fumes resulting from a fire, at 70° C. for example.

FIG. 3 gives a detailed view of the guiding rods (12) in the form of pipes with a blocking washer (16) on the upper part. The pin (15) keeps the spring (14) compressed and restrained from release. The protective cover is thus held in place by the braces (13) in such a way that the lower part of the cover is held against the iron plates (3). When, in the event of fire, the pin (15) melts, the positive pressure action of the spring is released and projects the cover upwards. The braces rise to the top of the rods (12) and come to rest against the blocks (16). A locking mechanism at the end of the upward travel of the cover, such as a catch or a ball mounted atop the rod (12) (not shown in the drawing), blocks the braces and thus keeps the cover in the raised position. The motor (1) is thus exposed to a cooling environment little different from that of its normal operation. An ordinary type of motor may thus be used as far as heating and its winding are concerned.

The variation in FIG. 2 gives another view of the upper part of the components in FIG. 1, except that the cover (8–9) is replaced by a cap (17), the springs (14) are replaced by a single spring (18) mounted on the upper part of the motor (1), and the attachment of the cap (17) is accomplished by means of feet (19), attached on one side to the cap on the other to the iron plates (3) on top of the platform (2), which is itself separately attached to the iron plates (3).

The attachment of the feet (19) to the iron plates (3) is accomplished by means of bolts (20) made of a fusible alloy (not shown) of the same type as that used for the pins (15). When these bolts melt under the action of hot fumes, the spring (18) ejects the cap (17) away from the motor-exhaust fan assembly. A retaining chain (21), attached on one end to the cap (17) and on the other end to the suction flange (4) for example, prevents the possibility of the cap's (17) falling on passersby. The protective grill (22) is not a fixed part of the cap and remains in place.

Although two working configurations have been described above, it is evident that other modifications introduced by those skilled in the art can be in conformity with the concept of the invention falling within the scope of the application as defined in the appended claims.

What is claimed is:

1. A motor-exhaust fan assembly having support means adapted to support the assembly at an end of an exhaust shaft and having a protective cover substantially surrounding the motor of the assembly, means urging said protective cover to move in a predetermined direction relative to said motor to expose said motor for cooling the same in the event of a severe rise in the temperature of gases exhausted from said exhaust shaft by said assembly, and restraining means for preventing said protective cover from moving in said predetermined direction until said severe rise in temperature, said restraining means comprising first means attached to said cover and movable therewith in said predetermined direction when said cover is not restrained by said restraining means and second means attached to said support means and positioned directly in the path of movement of said first means in said predetermined direction to block movement of said first means in said predetermined direction, said second means being composed of a fusible material which melts in response to said severe rise in temperature, whereupon said first means is no longer blocked and said cover is permitted to move in said predetermined direction by said urging means.

2. An assembly in accordance with claim 1, wherein said urging means comprises compression spring means compressed when movement of said first means in said predetermined direction is blocked by said second means.

3. An assembly in accordance with claim 1, wherein said first means comprises braces attached to said cover and wherein said second means comprises elements attached to said support means by guide rods projecting through openings in corresponding braces, said elements blocking movement of said braces along said rods, and wherein said spring means comprises compression springs surrounding said guide rods between said braces and said support means.

4. An assembly in accordance with claim 3, further comprising means on said guide rods for limiting movement of said braces along said guide rods after movement of said cover in said predetermined direction.

5. An assembly in accordance with claim 1, wherein said urging means comprises compression spring means compressed between the motor of said assembly and said protective cover, and flexible means connected between said cover and said support means for limiting the movement of said cover in said predetermined direction when said cover has moved in said predetermined direction.

* * * * *